US005586930A

United States Patent [19]

Hayashi et al.

[11] Patent Number: 5,586,930

[45] Date of Patent: Dec. 24, 1996

[54] GRINDING CHIP FITTING TYPE GRINDING PLATE

[75] Inventors: Teruoki Hayashi; Yoshio Shibai, both of Kyoto, Japan

[73] Assignee: Sanwa Kenma Kogyo Co., Ltd., Kyoto, Japan

[21] Appl. No.: 569,985

[22] Filed: Dec. 8, 1995

[30] Foreign Application Priority Data

Mar. 15, 1995 [JP] Japan ..... 7-056277

[51] Int. Cl.[6] ..... B23F 21/03

[52] U.S. Cl. ..... 451/548; 451/549

[58] Field of Search ..... 451/548, 549; 125/3, 28; 457/158, 259, 353, 359, 527

[56] References Cited

U.S. PATENT DOCUMENTS

| | | | |
|---|---|---|---|
| 2,425,368 | 8/1947 | Doermann | 451/548 |
| 2,442,129 | 5/1948 | Hollstrom | 451/548 |
| 3,121,982 | 2/1964 | Miller | 451/548 |
| 3,318,053 | 5/1967 | Miller | 451/548 |
| 3,464,166 | 9/1969 | Bouvier | 451/548 |
| 3,517,466 | 6/1970 | Bouvier | 451/548 |
| 4,597,225 | 7/1986 | Toncelli | 451/548 |
| 4,702,223 | 10/1987 | Swan | 125/3 |

*Primary Examiner*—D. S. Meislin
*Assistant Examiner*—George Nguyen
*Attorney, Agent, or Firm*—Sughrue, Mion, Zinn, Macpeak & Seas

[57] ABSTRACT

A grinding chip fitting type grinding plate uses grinding chips to which cylindrical mounting portions are added, thereby facilitating the attachment and removal of the grinding chips. The grinding plate comprises a plurality of grinding chips each having a cylindrical mounting portion, a grinding chip mounting plate to which the grinding chips are attached, and a holding plate. Each of the grinding chips is provided with an O-ring attached to the cylindrical mounting portion which has a front end to which a diamond chip is bonded. A projection portion is integrally formed at a rear end of the mounting portion. The grinding chip mounting plate has a plurality of grinding chip receiving holes which are radially provided. Each of the receiving holes is a stepped hole composed of a mounting portion receiving hole and a projection receiving hole which is radially offset with respect to the mounting portion receiving hole by a predetermined eccentric amount. The holding plate has a plurality of holes through which the diamond chips passe. The mounting portion of each of the grinding chips is inserted into the mounting portion receiving hole of the grinding chip mounting plate against the resistance of the O-ring. The projection is then rotated so that the grinding chip is fixed to the grinding chip mounting plate. The holding plate is coupled with the grinding chip mounting plate by attaching the holding plate from the side where the diamond chips exist.

11 Claims, 13 Drawing Sheets

GRINDING CHIP FITTING TYPE GRINDING PLATE

BACKGROUND OF THE INVENTION

1. Field of the Invention

The present invention relates to a grinding chip fitting type grinding plate suitable for grinding stones. More particularly, the present invention relates to an improvement of a grinding plate in which grinding chips each having a cylindrical mounting portion can be easily attached to and detached from the grinding plate.

2. Description of the Related Art

The assignee of the present invention disclosed a grinding chip fitting type grinding plate which achieves the same object as the present invention (see Japanese Utility Model Publication 58-15090). This grinding plate has a structure as shown in FIG. 1. That is, a plurality of chip receiving holes 3 are formed in the bottom surface of a base plate 2 having a rotation transmitting portion 1. The base portions of grinding chips 5 are fitted into the chip receiving holes 3 so that the grinding chips 5 are restricted in the rotational direction and the radial direction of the grinding plate. The base portion of each grinding chip 5 has a flange 4 with a tapered peripheral surface. Also, there is provided a holding plate 6. The holding plate 6 is provided with chip through holes 7 each having a tapered inner surface whose diameter is smaller than the diameter of the flange 4. The holding plate 6 is attached to the base plate 2 such that the grinding chips 5 enter the corresponding chip through holes 7 and the flanges 4 of the grinding chips 5 engage with the inner tapered surfaces of the chip through holes 7. The holding plate 6 is secured to the base plate 2 with a plurality of bolts 8 so that the grinding chips 5 are restricted in the axial direction.

The above-described grinding plate has many advantages as follows.

(a) Since movement of the grinding chips 5 in the rotational and radial directions of the grinding plate is restricted by the base plate 2, and movement of the grinding chips 5 in the axial direction is restricted by the holding plate 6. Accordingly, even when the grinding chips receive a lateral thrust or a shock from the surface of a stone during a grinding operation, the thrust or shock is resisted by the stiff base plate 2. Therefore, the weight of the holding plate 6 can be decreased, and the number of the bolts 8 for fastening the holding plate 6 can be decreased. In addition, the work for attaching or removing the grinding chips 5 can be simplified.

(b) The grinding chips 5 whose base portions are fitted into the receiving holes 3 of the base plate 2 are held together by the holding plate 6 for fixation. Therefore, when the grinding chips 5 are to be replaced with new grinding chips, they are easily removed from the base plate 2 by disassembling the holding plate 6.

(c) Since lateral thrust and shocks acting on the grinding chips 5 can be resisted by the strong base plate 2, there is some very play produced between the grinding chips 5 and the base plate 2. Even when play is produced, the grinding chips do not come off insofar as the holding plate 6 does not fall down. Therefore, the grinding plate is very safe.

(d) Once a user buys the base plate 2 and the holding plate 6 as a set, it is necessary for the user to buy only the grinding chips 5 even when grinding performance deteriorates. Accordingly, operational costs can be decreased.

(e) When the grinding chips 5 have worn unevenly, they can easily be exchanged. Also, the layout (positions) of the grinding chips 5 can be changed.

(f) When part of the grinding chips 5 are damaged, the grinding plate can easily be repaired by replacing the damaged grinding chips with new ones.

(g) The grinding chips 5 can be formed simultaneously using a die, and the base 2 and the holding plate 6 have simple structures. Therefore, manufacturing costs can be decreased.

(h) A manufacturer or dealer is required to send to a user only grinding chips. Transportation and packaging become simpler.

SUMMARY OF THE INVENTION

An object of the present invention is to provide a grinding chip fitting type grinding plate which takes advantage of the features of the above-described conventional grinding plate, and which has an improved structure for facilitating the attachment and removal of grinding chips.

A grinding tip fitting type grinding plate according to a first aspect of the present invention comprises a plurality of grinding chips each having a cylindrical mounting portion, a grinding chip mounting plate to which the grinding chips are attached, and a holding plate.

Each of the grinding chips is provided with an O-ring attached to the cylindrical mounting portion having a front end to which a diamond chip is boned, and a projection portion is integrally formed at a rear end of the mounting portion.

The grinding chip mounting plate has a plurality of grinding chip receiving holes which are radially provided, and each of the receiving holes is a stepped hole composed of a mounting portion receiving hole and a projection receiving hole which is radially offset with respect to the mounting portion receiving hole by a predetermined eccentric amount.

The holding plate has a plurality of holes through each of which the diamond chip passes.

The mounting portion of each of the grinding chips is inserted into the mounting portion receiving hole of the grinding chip mounting plate against the resistance of the O-ring, the projection is rotated so that the grinding chip is fixed to the grinding chip mounting plate, and the holding plate is coupled with the grinding chip mounting plate by attaching the holding plate from the side where the diamond chip exists.

The diamond chip may have a circular cross section or an elongated cross section.

In the grinding plate according to the first aspect, each grinding chip can be attached to the mounting plate by a simple action in which the mounting portion of each grinding chip is inserted into the mounting portion receiving hole, and then the projection received by the projection receiving hole is rotated. Then the holding plate is coupled to the grinding chip mounting plate from the side where the diamond chips exist. Therefore, the attachment and removal of the grinding chip can be simplified.

A grinding chip fitting type grinding plate according to a second aspect of the present invention comprises a plurality of grinding chips, a circular chip mounting plate to which the grinding chips are attached, and a circular base plate to which the chip mounting plate is attached.

Each of the grinding chips comprises a diamond chip and a mounting portion, and the mounting portion has a smaller diameter portion which is projected from the rear end of the mounting portion and is provided with an O-ring, and an upper projection which is projected from the tip of the smaller diameter portion and has a pair of parallel flat surfaces formed by cutting away the upper projection from diametrically opposite sides.

The chip mounting plate has a plurality of receiving holes which are radially arranged so as to receive the plurality of grinding chips, and each of the receiving holes has a mounting portion receiving hole and a smaller diameter portion receiving hole which has a diameter smaller than that of the mounting portion receiving hole and is radially offset with respect to the mounting portion receiving hole by a predetermined eccentric amount.

The base plate has a plurality of depressions for receiving the mounting portions of the plurality of grinding chips attached to the chip mounting plate, and each of the depressions has a circular hole into which the smaller diameter portion of the mounting portion is inserted, and an elongated hole which is deeper than the circular hole and to which the upper projection of the mounting portion is inserted.

The base plate and the chip mounting plate are integrated with each other using bolts such that the mounting portions of the grounding chips attached to the chip mounting plate are received by the depressions of the base plate.

The diamond chip may have a circular cross section or an elongated cross section.

In the grinding plate according to the second aspect, the grinding chips are attached to the chip mounting plate such that the mounting portions of the grinding chips project upward from the chip mounting plate. The chip mounting plate is then superposed on the base plate such that the mounting portions of the grinding chips are received by the depressions of the base plate. The chip mounting plate and the base plate are integrated using bolts to complete the grinding plate. During the above-described assembling operation, each grinding chip can easily be fixed to the mounting plate by rotating the upper projection portion provided on the mounting portion.

A grinding tip fitting type grinding plate according to a third aspect of the present invention comprises a plurality of grinding chips, a circular chip mounting plate to which the grinding chips are attached, and a circular base plate to which the chip mounting plate is coupled.

Each of the grinding chips has a mounting portion and a grinding chip shaft projected from the mounting portion, and the grinding chip shaft has a circumferential groove 45 in its intermediate portion.

The chip mounting plate has depressions to which the mounting portions of the grinding chips are fitted, and through holes through which the grinding chip shafts are inserted.

The base plate has depressions for receiving elastic members, and insertion holes for the grinding chip shafts of the grinding chips, and the grinding chip shafts are held and fixed to the base plate by a pressing force produced by the elastic members.

The diamond chip may have a circular cross section or an elongated cross section.

The elastic member is preferably soft urethane.

In the grinding plate according to the third aspect, the elastic member made of an elastic material such as soft urethane tightly engages with the circumferential groove of the grinding chip shaft due to a pressing force produced by the elastic member. Accordingly, the grinding chip shaft is prevented from coming off.

DESCRIPTION OF PREFERRED EMBODIMENTS

Figures 1, 5A:
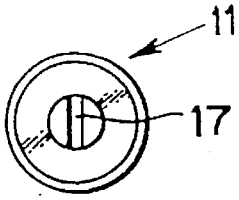
FIG. 5A and FIG. 5B show grinding chips used in the first embodiment.
Figures 2, 5A:
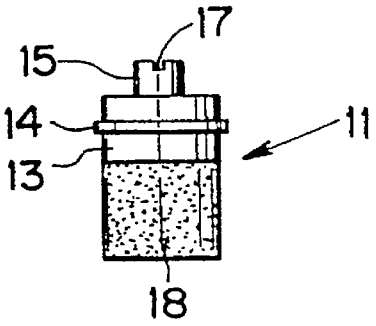
Figures 1, 5B:
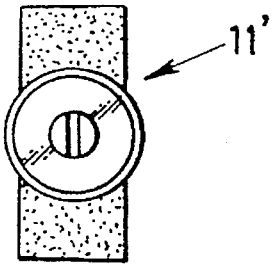
Figures 2, 5B:
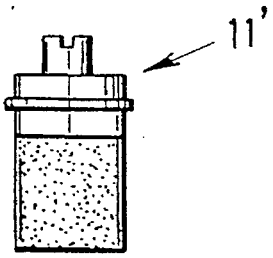

A first embodiment of the present invention will now be described with reference to FIG. 3 through FIG. 7. In the present embodiment, a grinding chip 11 shown in FIG. 5A or a grinding chip 11' shown in FIG. 5B is selectively attached to a grinding chip mounting plate 12. As shown in FIGS. 5A and 5B, each of the grinding chips 11 and 11' is provided with an O-ring 14 which is attached to a mounting portion 13 having a circular cross section. A projection 15 is projected from the rear end of the mounting portion 13.

In the following description, it is assumed that a plurality of grinding chips 11 shown in FIG. 5A are to be attached to the grinding chip mounting plate 12. Each receiving hole 16 formed in the chip mounting plate 12 is a stepped hole which is composed of a mounting portion receiving hole **16*a* and a projection receiving hole 16*b* which has a diameter smaller than that of the mounting portion receiving hole 16*a*, as shown in FIG. 3**A.

Figure 3B:
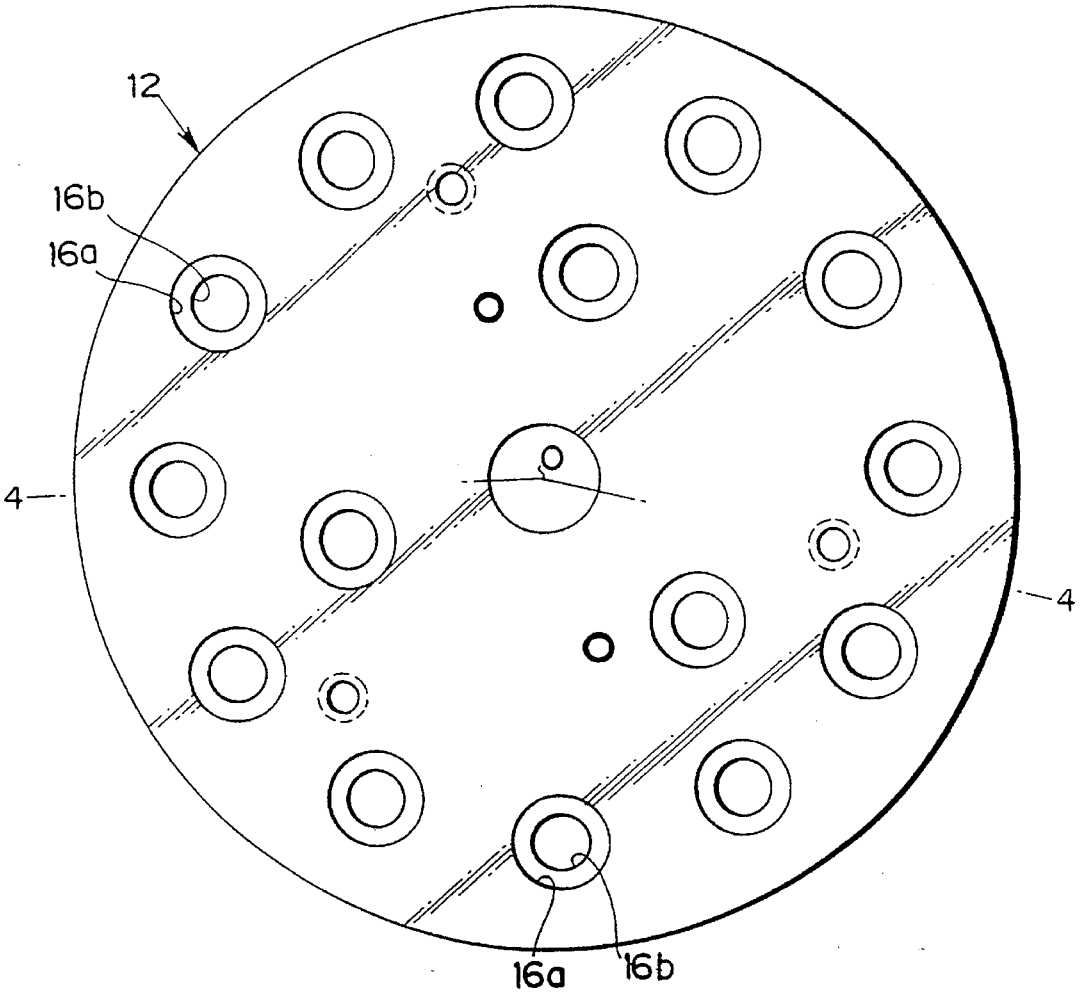
FIG. 3B is an enlarge view of a receiving hole shown in FIG. 3A.
Figure 3A:
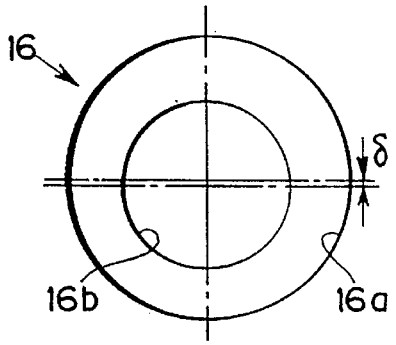
FIG. 3A is a plane view of a grinding chip mounting plate according to a first embodiment of the present invention.
Figure 4:
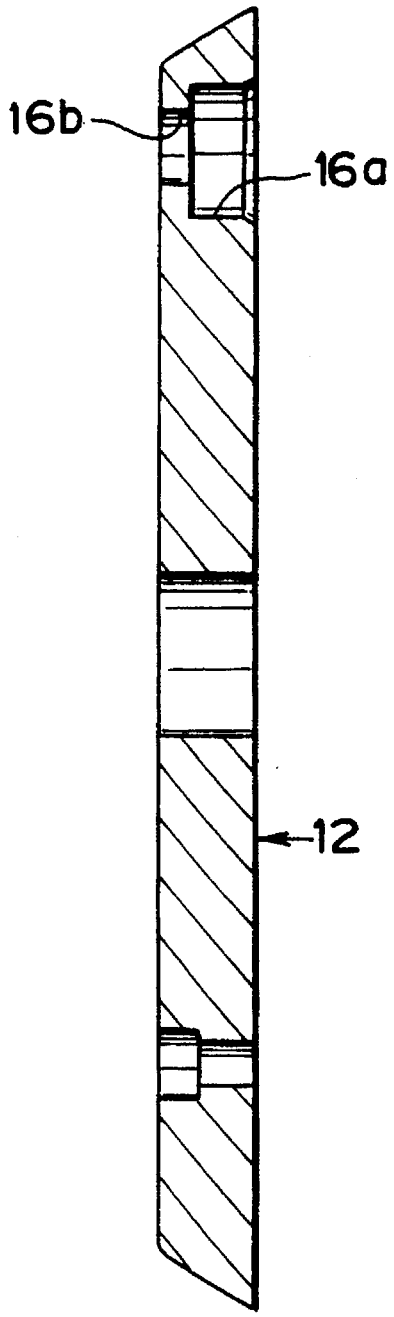
FIG. 4 is a cross-sectional view taken along line A-O -A' in FIG. 3A.

As shown in FIG. 3B, the projection receiving hole **16*b* is radially offset with respect to the mounting portion receiving hole 16*a* by an eccentric amount δ. With this structure, when the mounting portion 13 is inserted into the mounting portion receiving hole 16*a* against the resistance of the O-ring 14 and the projection 15 is rotated about its center axis with a driver or the like, the mounting portion 13 is pressed against the inner surface of the mounting portion receiving hole 16*a* due to the eccentricity in the amount δ. As a result, each grinding chip 11 is fixed to the chip mounting plate 12. Numeral 17 denotes a groove provided at the tip of the projection 15. The grinding chip 11 is rotated with a drive which engages with the groove 17**.

Figure 6:
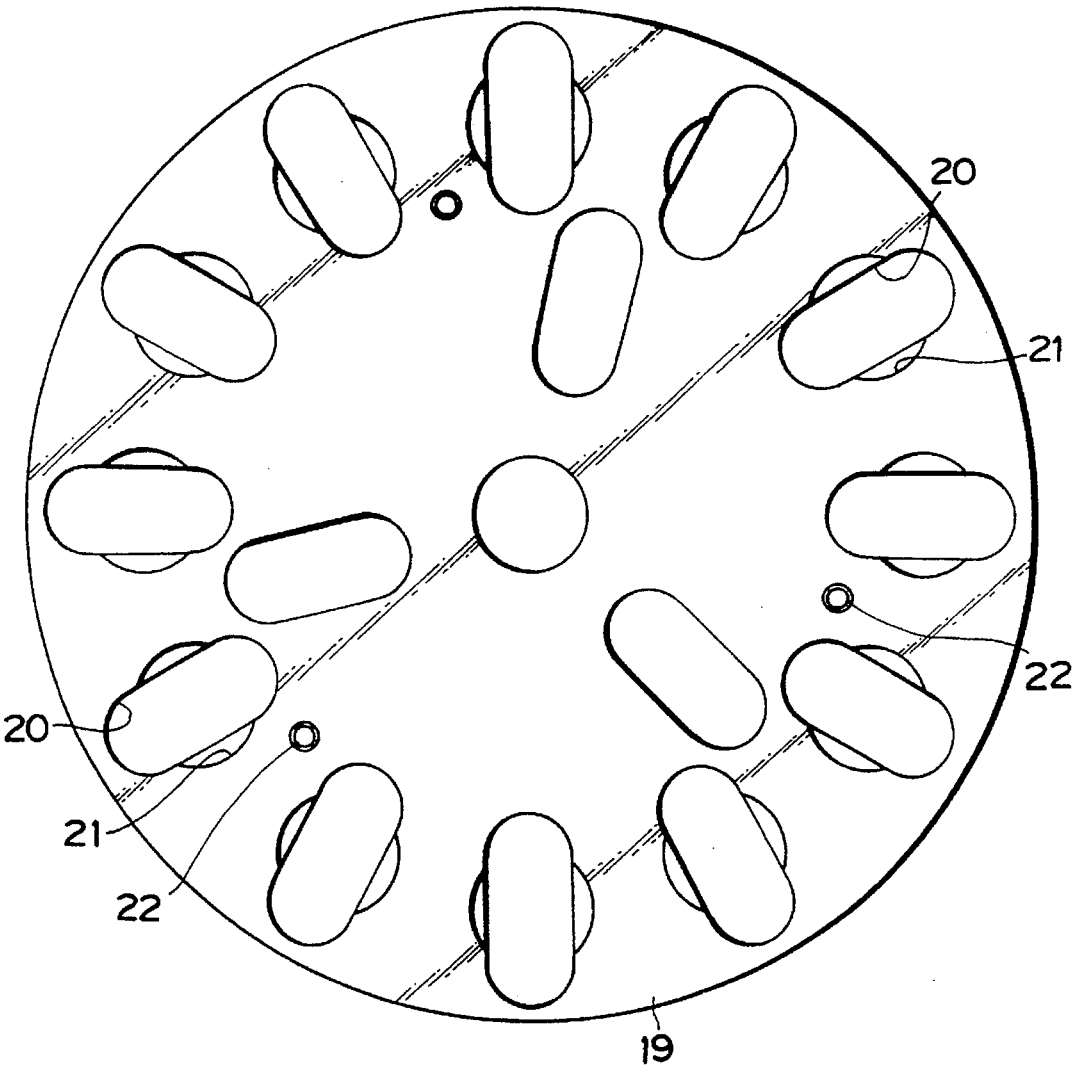
FIG. 6 is a plane view of a holding plate used in the first embodiment.
Figure 7:
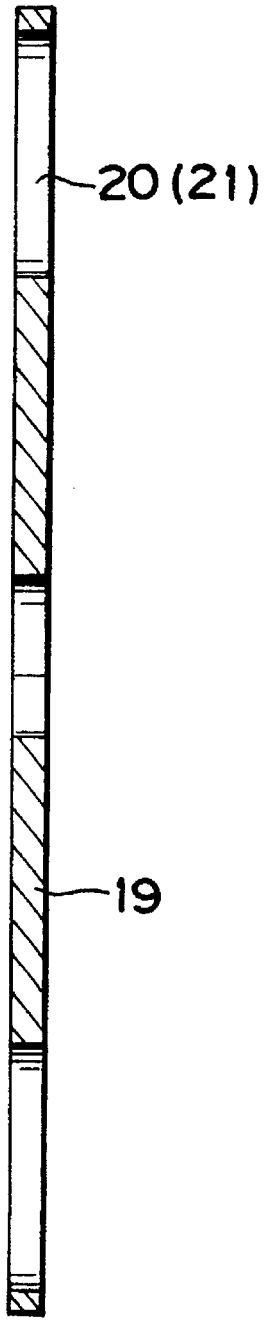
FIG. 7 is a cross-sectional view of the holding plate shown in FIG. 6.

FIG. 6 and FIG. 7 show a holding plate 19 which is superposed on the grinding chip mounting plate 12 from the side where the diamond chips 18 of the grinding chips 11 exist. In the holding plate 19, elliptic holes 20 and circular holes 21 are formed in a combined manner. For the cylindrical grinding chip 11 shown in FIG. 5A, the circular holes 21 are used. The holding plate 19 is closely contacted to the surface of the chip mounting plate 12, and bolts are screwed to the chip mounting plate 12 through a plurality of screw holes 22 (see FIG. 6) to fix the holding plate 19 to the chip mounting plate 12. After completing assembly of the grinding plate, the chip mounting plate 12 is attached to a rotation transmitting portion (not shown), and is used for grinding. Since the cylindrical grinding chips 11 are securely positioned in the rotational and radial directions of the grinding plate during grinding operation, the grinding operation can be performed smoothly. The elliptic holes 20 are positioning holes for the use of the rectangular grinding chips 11'. The holding plate shown in FIG. 6 is used for both grinding chips with cylindrical diamond chips and grinding chips with rectangular diamond chips. However, a holding plate dedicated to grinding chips with cylindrical diamond chips and a holding plate dedicated to grinding chips with rectangular diamond chips may be made separately.

Figure 1:
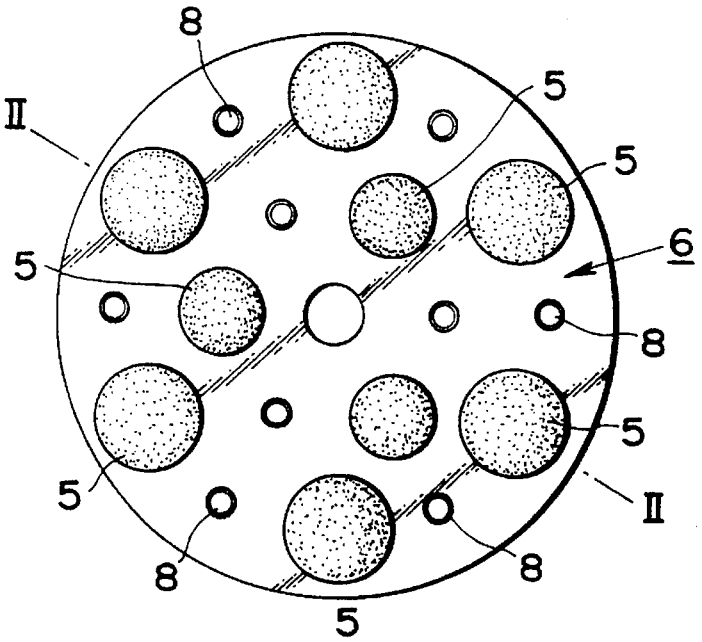
FIG.1 (PRIOR ART)
FIG. 1 is a plane view of a conventional grinding chip fitting type grinding plate.
Figure 2:
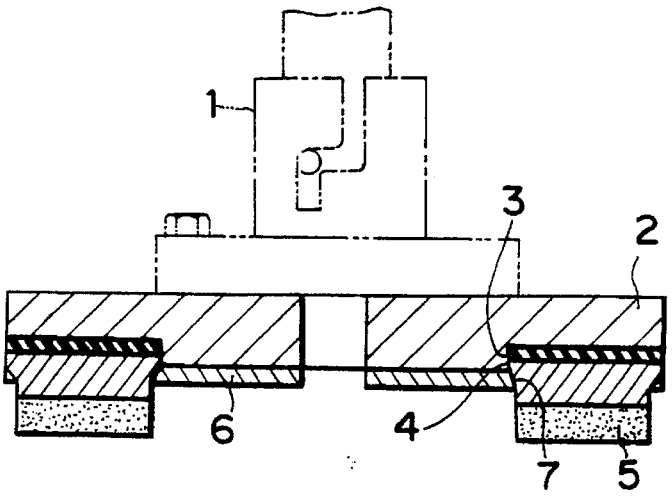
FIG.2 (PRIOR ART)
FIG. 2 is a cross-sectional view taken along line II—II in FIG. 1.

As is apparent from the above description, since the chip mounting plate 12 is directly connected to the rotation transmitting portion, the chip mounting plate 12 serves as the base plate of the conventional grinding plate (see FIG. 2).

In the grinding plate according to the present embodiment, the mounting portion 13 of each grinding chip is inserted into the mounting portion receiving hole **16*a* of the grinding chip mounting plate 12, and the projection 15 received by the projection receiving hole 16*b*, which is offset from the mounting portion receiving hole 16*a* by the eccentric amount δ, is rotated. With this operation, the grinding chip 11 is fixed to the grinding chip mounting plate 12. Then, the holding plate 19 is made to approach to the grinding chip mounting plate 12 from the side where the diamond chips 18** exist and is coupled therewith.

Since the grinding plate according to the present embodiment has the above-described structure, each grinding chip can be attached to the grinding plate by a simple action in which the cylindrical mounting portion is inserted into a receiving hole and then turned. Accordingly, the operation for the attachment of the grinding chips can be facilitated.

In addition, the assembly of the grinding plate can be completed by coupling the holding plate 19 with the grinding chip mounting plate 12 from the side where the diamond chips 18 exist and by fixing the holding plate 19 to the grinding chip mounting plate 12. Since the grinding chip mounting plate also functions as a base plate, the positioning of each grinding chip can perfectly be carried out. In addition, the structure can be considerably simplified.

Figures 1, 10A:
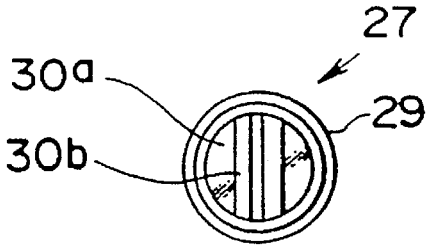
FIG. 10A shows a grinding chip with a cylindrical diamond chip.
Figures 2, 10A:
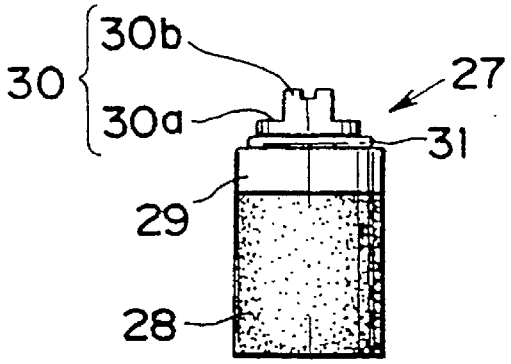
Figures 1, 10B:
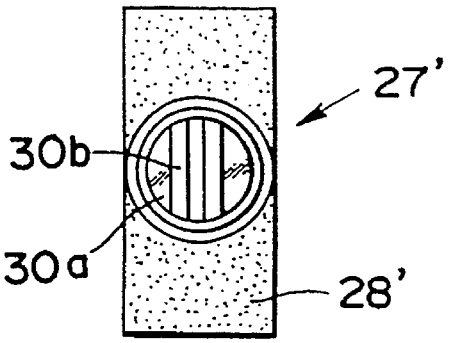
FIG. 10B shows a grinding chip with a rectangular diamond chip.
Figures 2, 10B:
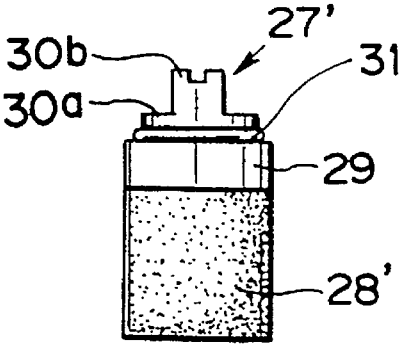

A second embodiment of the present invention will now be described with reference to FIG. 8A through FIG. 12. In the present embodiment, a grinding chip 27 shown in FIG. 10A or a grinding chip 27' shown in 10B is selectively used. For example, the grinding chip 27 shown in FIG. 10A with a cylindrical diamond chip 28 is provided with a mounting portion which has a large diameter and to which the diamond chip 28 is fixed, a smaller diameter portion **30*a* projected from the rear end of the mounting portion 29, and an upper projection 30*b* projected from the tip of the smaller diameter portion 30*a*. The upper projection 30*b* is cut away from diametrically opposite sides thereof so that a pair of parallel flat surfaces are formed. An O-ring 31 is fitted onto the smaller diameter portion 30*a* of the mounting portion 29. When the grinding chip 27 is attached to a chip mounting plate 32 (FIG. 8A), the mounting portion 29 is inserted into a receiving hole formed in the chip mounting plate 32 against the resistance of the O-ring 31. FIG. 10B shows a grinding chip with a rectangular diamond chip 28'. The structure of the mounting portion of this grinding chip is the same as that of the grinding chip shown in FIG. 10**A which has a cylindrical diamond chip.

Figure 8A:
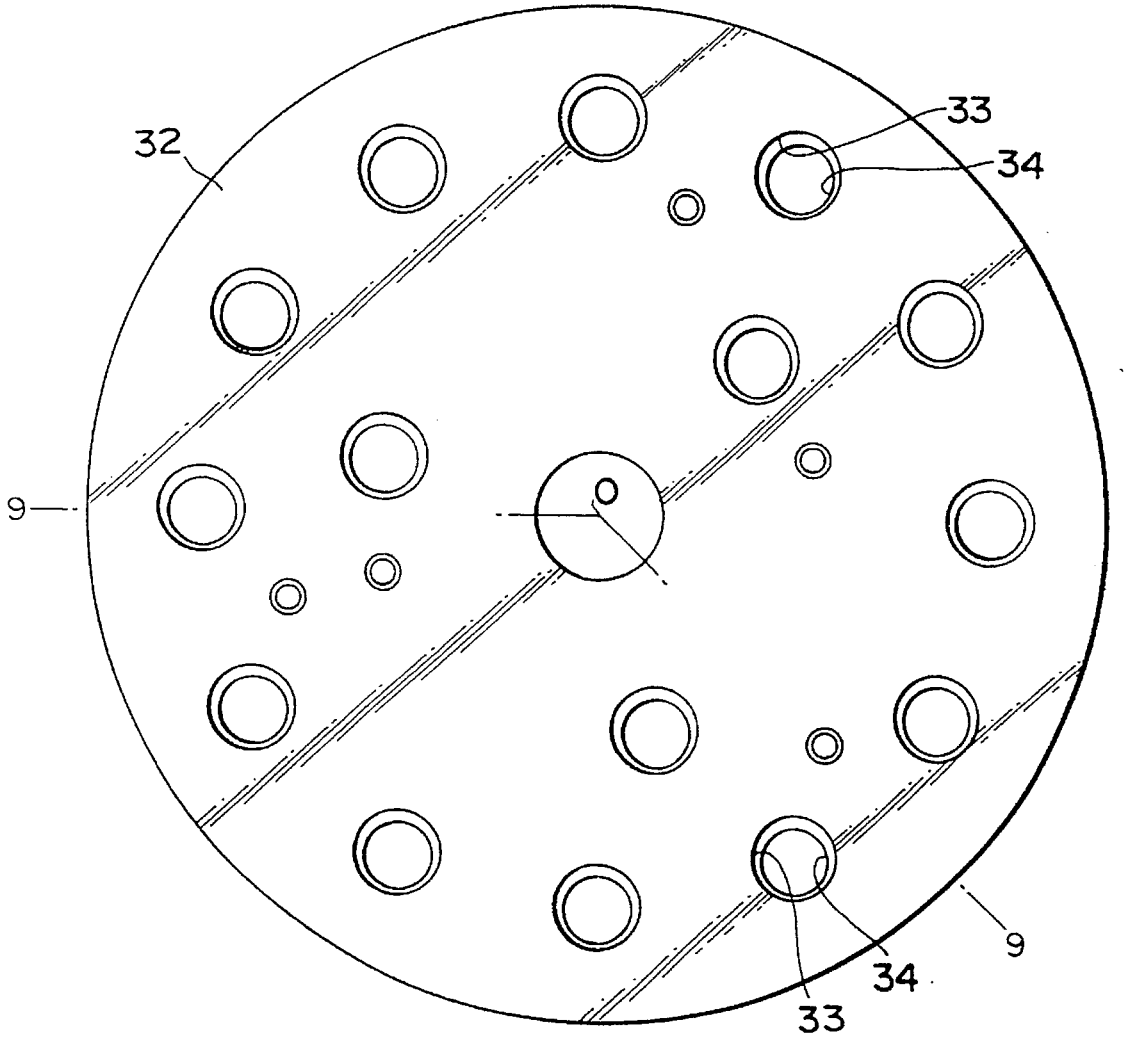
FIG. 8A is a plane view of a chip mounting plate according to a second embodiment of the present invention.
Figure 8B:
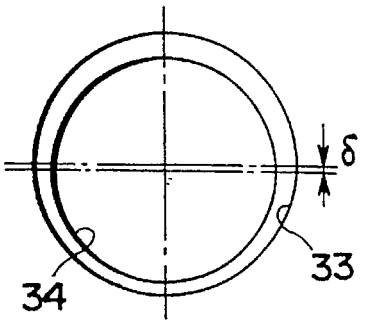
FIG. 8B is an enlarge view of a grinding chip receiving hole shown in FIG. 8A.
Figure 9:
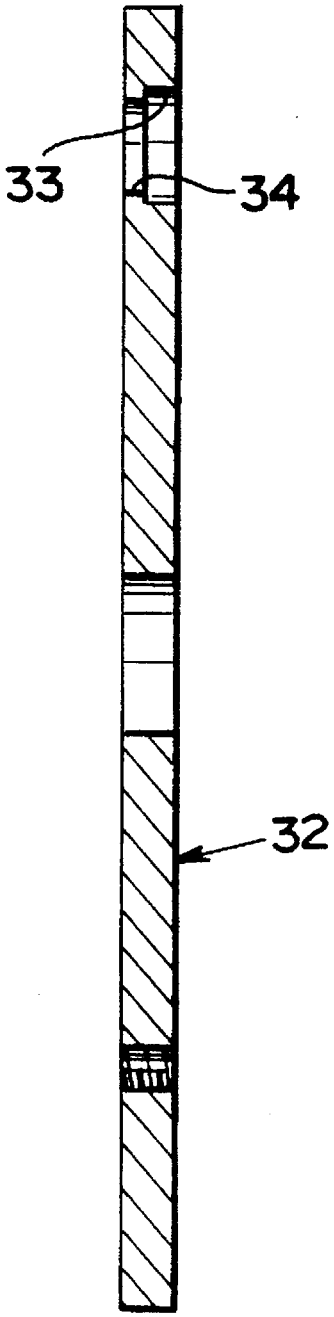
FIG. 9 is a cross-sectional view taken along line A-O -A' in FIG. 8.

The chip mounting plate 32 has a plurality of mounting portion receiving holes 33 into which the mounting portions 29 of the grinding chips 27 are inserted, and a plurality of smaller diameter portion receiving holes 34 into which the smaller diameter portions of the grinding chips 27 are inserted. As shown in FIG. 8B, each smaller diameter portion receiving hole 34 is radially offset with respect to the mounting portion receiving hole 33 by an eccentric amount δ. When the grinding chip 27 is attached to the chip mounting plate 32, the mounting portion 29 of the grinding chip 27 is inserted into the mounting portion receiving hole 33 from the front side of the chip mounting plate 32 in FIG. 8A while inserting the smaller diameter portion **30*a* into the smaller diameter portion receiving hole 34 against the resistance of the O-ring 31. As a result, the smaller diameter portion 30*a* is received by the smaller diameter portion receiving hole 34. When the upper projection 30*b* is rotated by a hand, driver or the like, the smaller diameter portion 30*a* is closely contacted with the smaller diameter portion receiving hole 34 because the smaller diameter portion receiving hole 34** is offset by the amount δ.

The grinding chip 27' shown in FIG. 10B which has a rectangular diamond chip 28' can be attached to the chip mounting plate 32 in the same manner.

Figure 11:
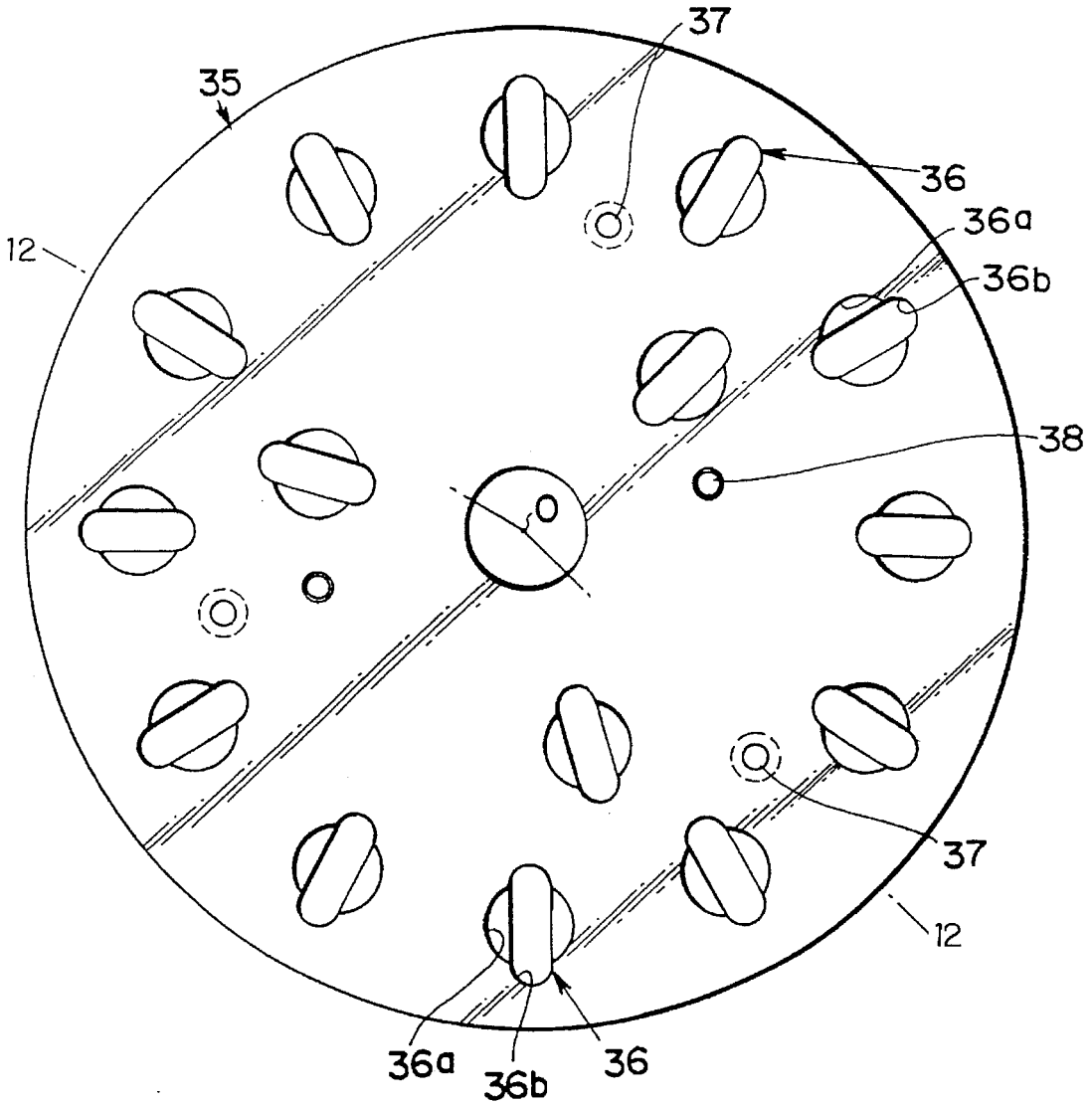
FIG. 11 is a plane view of a base plate used in the second embodiment.
Figure 12:
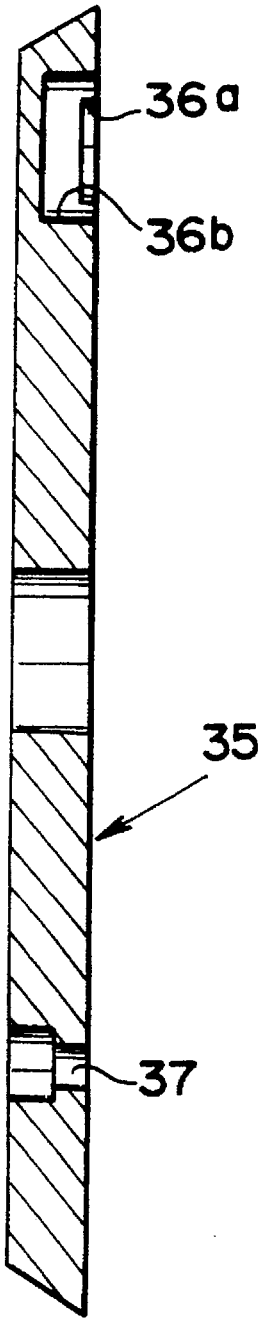
FIG. 12 is a cross-sectional view taken along line A-O -A' in FIG. 11.

FIG. 11 and FIG. 12 show a substrate 35 which also functions as a positioning plate. The base plate 35 has a plurality of depressions 36, the number of which corresponds to the number of the grinding chips 27. Each depression 36 is composed of a circular hole **36*a* for receiving the smaller diameter portion 30*a* of the mounting portion of the grinding chip 27, and an elongated hole 36*b* for receiving the upper projection 30*b*. Numeral 37 denotes holes for bolts used for attachment to a rotation transmitting portion (not shown), and numeral 38 denotes holes for bolts used for attaching the grinding chip mounting plate 32 to the base 35**.

Method of Attaching Grinding Chips (1) Each grinding chip 27 is inserted into the mounting portion receiving hole 33 of the grinding chip mounting plate 32. At this time, the mounting portion 29 is inserted into the mounting portion receiving hole 33 against the resistance of the O-ring 31.

(2) The upper projection **30*b* is rotated to press the mounting portion against the inner surface of the mounting portion receiving hole 33** for fixation.

(3) The base plate 35 is superposed on the chip mounting plate 32 and is fixed thereto. At this time, they are coupled with each other such that the smaller diameter portions 30*a* and the upper projections 30*b* are received by the circular holes 36*a* and the elongated holes 36*b*, respectively.

In the grinding plate according to the present embodiment, the mounting portion of each grinding chip has a smaller diameter portion 30*a* and an upper projection 30*b*. On the other hand, each receiving hole formed in the chip mounting plate 32 is a stepped hole composed of a mounting portion receiving hole 33 and a smaller diameter portion receiving hole 34 which is offset from the mounting portion receiving hole 33 by an eccentric amount δ. Accordingly, each grinding chip can easily be attached by rotating the upper projection 30*b* after insertion of the grinding chip. This can be done because of the existence of the eccentricity of the amount δ.

Since the base plate 35 has depressions each composed of a circular hole 36*a* and an elongated hole 36*b* which is deeper than the circular hole 36*a*, the mounting portions 29 of the grinding chips can be received by them without causing interference. In addition, each grinding chip can be prevented from moving against forces in the radial and rotational directions of the grinding plate because of the existence of the depressions 36.

Figure 13A:
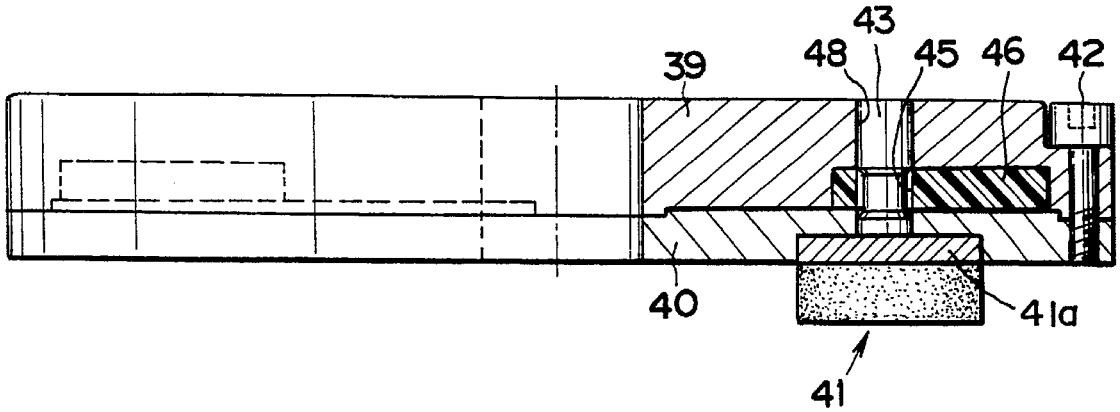
FIG. 13A is a partially sectioned view of a grinding plate according to a third embodiment of the present invention.
Figure 13B:
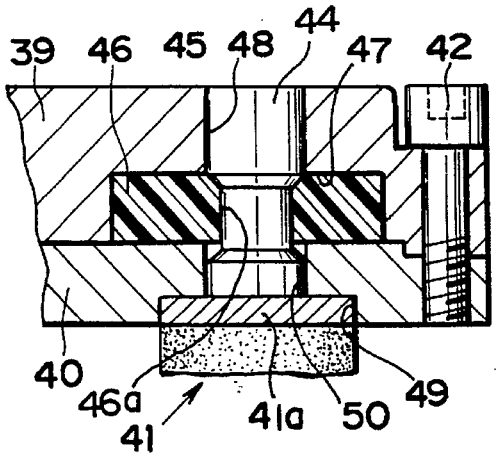
FIG. 13B is an enlarged view of the main portion of the grinding plate of the third embodiment.
Figure 14:
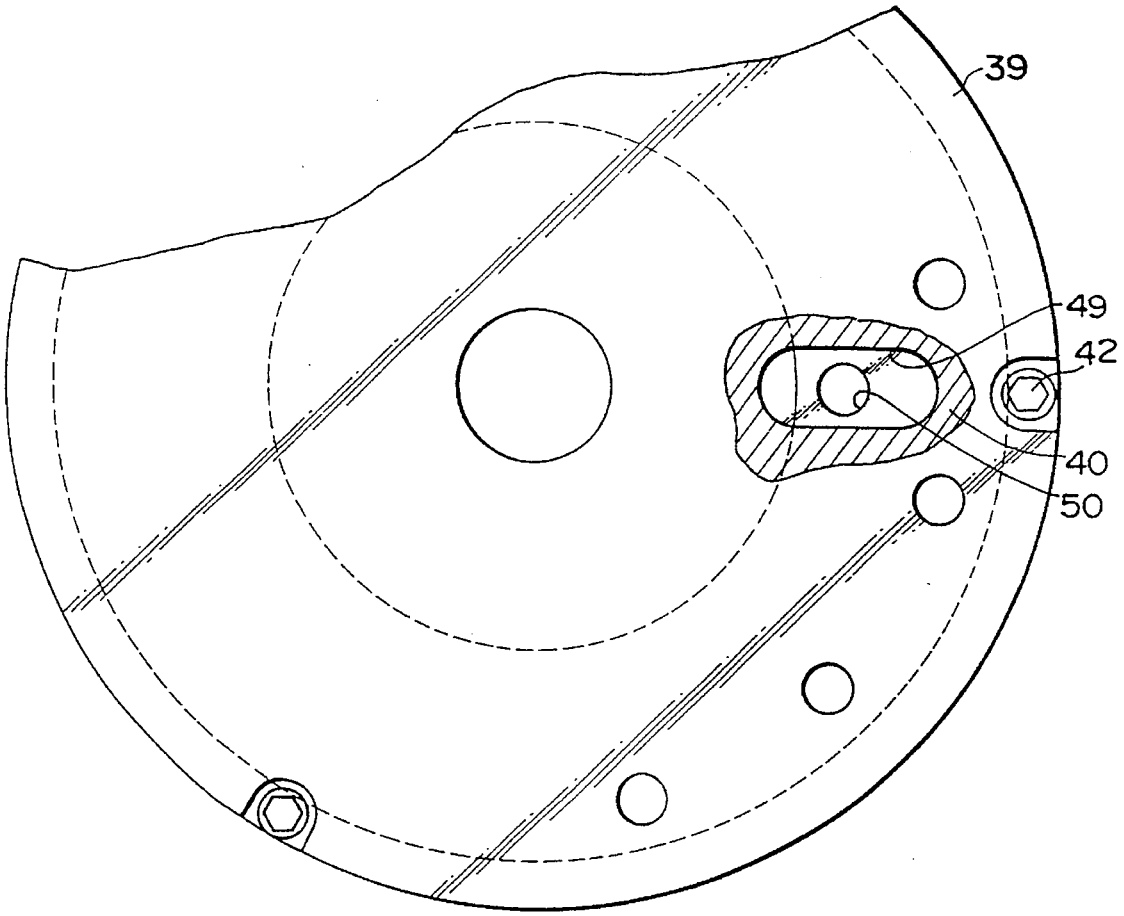
FIG. 14 is a partially sectioned plane view of the grinding plate of the third embodiment.

A third embodiment of the present invention will now be described with reference to FIGS. 13A, 13B and 14. In the present embodiment, as in the second embodiment, a chip mounting plate 40 to which a plurality of grinding chips 41 have been attached is fixed to a base plate 39 with fastening bolts 42. Although the grinding chip 41 shown in the drawings is an elliptic type, the grinding chip 41 may be a cylindrical type.

A grinding chip shaft 43 is coaxially fixed to a mounting portion 41*a* of each grinding chip 41. A circumferential groove 45 is formed in the intermediate portion of the grinding chip shaft 43. Numeral 46 denotes an elastic member made of an elastic material such as soft urethane. The elastic member 46 is caused to engage with the circumferential groove 45 with pressure. The grinding chip shaft 43 is prevented from coming off due to the pressure generated by the elastic member 46.

The base plate 39 has a plurality of depressions 47 each adapted to receive the elastic member 46. The elastic member 46, which has a thickness greater than the depth of the depression 47, is fitted into the depression 47. Numeral 48 denotes holes for receiving the grinding chip shafts 43. The chip mounting plate 40 has a plurality of depressions 49 for receiving the mounting portions 41*a* of the grinding chips 41, and a plurality of through holes 50 into which the grinding chip shafts 43 are inserted. The number of the depressions 49 and the number of the through holes 50 are the same as the number of grinding chips to be attached.

Each grinding chip 41 is attached as follows. The elastic member 46 is fitted into each of the depressions 47 of the base plate 39. After that, each grinding chip shaft 43 is inserted into a grinding chip shaft receiving hole 46*a* of the elastic member 46 and the through hole 50 formed in the base plate 39. The base plate 39 and the grinding chip mounting plate 40 are then fastened together using fastening bolts 42. As a result, the elastic member 46 is compressed within the depression 47 so that part of the elastic member 46 enters and contacts the circumferential groove 45 of the grinding chip shaft 43 with pressure. The grinding chip 41 is therefore prevented from coming off by the pressure produced by the elastic member 46.

In the grinding plate according to the present embodiment, the elastic member 46 made of an elastic material such as soft urethane enters the circumferential groove 46*a* of the grinding chip shaft 43 of each grinding chip 41 so that the grinding chip 41 can be fixed by the pressing force generated by the elastic member. Therefore, the attachment of the grinding chips can be performed easily.

What is claimed is:

1. A grinding chip fitting type grinding plate comprising a plurality of grinding chips each having a cylindrical mounting portion, a grinding chip mounting plate to which the grinding chips are attached, and a holding plate, wherein each of said grinding chips is provided with an O-ring attached to the cylindrical mounting portion having a front end to which a diamond chip is bonded, and a projection portion is integrally formed at a rear end of the mounting portion;

said grinding chip mounting plate has a plurality of grinding chip receiving holes which are radially provided, and each of the receiving holes is a stepped hole composed of a mounting portion receiving hole and a projection receiving hole which is radially offset with respect to the mounting portion receiving hole by a predetermined eccentric amount; and said holding plate has a plurality of holes through each of which the diamond chip passes, wherein the mounting portion of each of said grinding chips is inserted into the mounting portion receiving hole of said grinding chip mounting plate against the resistance of the O-ring, the projection is rotated so that said grinding chip is fixed to said grinding chip mounting plate, and said holding plate is coupled with said grinding chip mounting plate by attaching said holding plate from the side where the diamond chip exists.

2. A grinding chip fitting type grinding plate according to claim 1, wherein said diamond chip has a circular cross section.

3. A grinding chip fitting type grinding plate according to claim 1, wherein said diamond chip has an elongated cross section.

4. A grinding chip fitting type grinding plate comprising a plurality of grinding chips, a circular chip mounting plate to which the grinding chips are attached, and a circular base plate to which said chip mounting plate is attached, wherein each of said grinding chips comprises a diamond chip and a mounting portion, and the mounting portion has a smaller diameter portion which is projected from the rear end of the mounting portion and is provided with an O-ring, and an upper projection which is projected from the tip of the smaller diameter portion and has a pair of parallel flat surfaces formed by cutting away the upper projection from diametrically opposite sides thereof;

said chip mounting plate has a plurality of receiving holes which are radially arranged so as to receive the plurality of grinding chips, and each of the receiving holes has a mounting portion receiving hole and a smaller diameter portion receiving hole which has a diameter smaller than that of the mounting portion receiving hole and is radially offset with respect to the mounting portion receiving hole by a predetermined eccentric amount; and said base plate has a plurality of depressions for receiving the mounting portions of the plurality of grinding chips attached to the chip mounting plate, and each of the depressions has a circular hole into which the smaller diameter portion of the mounting portion is inserted, and an elongated hole which is deeper than the circular hole and to which the upper projection of the mounting portion is inserted, wherein said base plate and said chip mounting plate are integrated with each other using bolts such that the mounting portions of said grounding chips attached to said chip mounting plate are received by the depressions of said base plate.

5. A grinding chip fitting type grinding plate according to claim 4, wherein said diamond chip has a circular cross section.

6. A grinding chip fitting type grinding plate according to claim 4, wherein said diamond chip has an elongated cross section.

7. A grinding chip fitting type grinding plate comprising a plurality of grinding chips, a circular chip mounting plate to which the grinding chips are attached, and a circular base plate to which said chip mounting plate is coupled;

each of said grinding chips has a mounting portion and a grinding chip shaft projected from the mounting portion, and the grinding chip shaft has a circumferential groove 45 in its intermediate portion; and said chip mounting plate has depressions to which the mounting portions of said grinding chips are fitted, and through holes through which the grinding chip shafts are inserted, wherein said base plate has depressions for receiving elastic members, and insertion holes for the grinding chip shafts of said grinding chip's, and the grinding chip shafts are held and fixed to said base plate by a pressing force produced by the elastic members.

8. A grinding chip fitting type grinding plate according to claim 7, wherein said diamond chip has a circular cross section.

9. A grinding chip fitting type grinding plate according to claim 8, wherein said elastic member is made of soft urethane.

10. A grinding chip fitting type grinding plate according to claim 7, wherein said diamond chip has an elongated cross section.

11. A grinding chip fitting type grinding plate according to claim 10, wherein said elastic member is made of soft urethane.

* * * * *